United States Patent [19]

Grupping

[11] Patent Number: 4,502,539

[45] Date of Patent: Mar. 5, 1985

[54] METHOD FOR THE UNDERGROUND GASIFICATION OF COAL OR BROWNCOAL

[76] Inventor: Arnold W. Grupping, Anjelierenlaan 3, Aerdenhout, Netherlands, 2111 BP

[21] Appl. No.: 471,246

[22] Filed: Mar. 2, 1983

[30] Foreign Application Priority Data

Mar. 11, 1982 [NL] Netherlands ..... 8201003

[51] Int. Cl.[3] ..... C10J 5/00; E21C 43/00

[52] U.S. Cl. ..... 166/262; 166/263; 166/292

[58] Field of Search ..... 166/262, 256, 251, 292, 166/285, 263, 261

[56] References Cited

U.S. PATENT DOCUMENTS

| | | | |
|---|---|---|---|
| 3,001,776 | 9/1961 | Van Poollen | 166/256 X |
| 3,076,505 | 2/1963 | Pryor | 166/262 |
| 3,952,802 | 4/1976 | Terry | 166/262 |
| 4,036,298 | 7/1977 | Kreinen et al. | 166/256 X |
| 4,102,397 | 7/1978 | Terry | 166/262 X |
| 4,222,437 | 9/1980 | Sabol | 166/256 X |

FOREIGN PATENT DOCUMENTS

| | | | |
|---|---|---|---|
| 0002306 | 6/1979 | European Pat. Off. | 166/256 |
| 0053418 | 6/1982 | European Pat. Off. | 166/256 |

*Primary Examiner*—Stephen J. Novosad

*Attorney, Agent, or Firm*—Beehler, Pavitt, Siegemund, Jagger & Martella

[57] ABSTRACT

A method for the underground gasification of coal or browncoal, using two boreholes extending through a coal layer with the slope of said layer, for supplying oxygen to a combustion and gasification front in said layer and discharging combustion gases respectively, a filler material being intermittently supplied through one of said boreholes for filling the cavity produced by burning away the coal layer. According to the invention, said filling is started at a moment before the combustion front has reached the discharge borehole, and in particular before the overlying formations will collapse to such a degree that an inadmissible subsidence at the ground level would develop. Thereafter the combustion and gasification is restarted in the same or the opposite sense as may be required for adjusting the orientation of the gasification front in the desired direction.

5 Claims, 3 Drawing Figures

METHOD FOR THE UNDERGROUND GASIFICATION OF COAL OR BROWNCOAL

The invention relates to a method for the underground gasification of coal or browncoal in an inclined coal layer, in which two boreholes are drilled from the ground level into the coal layer, which boreholes are continued downwards in said layer with the slope of said layer, and are interconnected at their lower ends, after which the coal can be ignited, and, furthermore, by supplying an oxygen containing gas through one of the boreholes and discharging the combustion gases through the other borehole, the combustion and gasification front will be propagated upslope through the coal layer, care being taken that the boreholes remain in communication with the cavity behind the combustion front, which cavity is intermittently filled with a filler which is supplied through one of the boreholes.

Such a method has been described in the prior NL patent applications 77 10 184 and 80 06 485 "(corresponding to U.S. Pat. No. 4,243,101 and U.S. Pat. No. 4,441,544, respectively)" of the same applicant. According to this known method, a gas chamber expands itself from the supply borehole in two directions, viz. in the direction of the discharge borehole and perpendicularly thereto. The expansion in the latter direction continues until the transverse section of the gas chamber has obtained such a perimeter that the gas flow becomes laminar, so that the oxygen can no longer sufficiently come into contact with the coal. The stagnation of the gasification in this direction is also promoted by increasing heat losses towards the roof and bottom rock formations thus a gas chamber originating from some connecting channel between both boreholes will gradually expand in the direction of the discharge borehole, and the remaining connecting channel between said chamber and the discharge borehole will become shorter and shorter.

When at the upstream side substantial collapses occur, so that, there a part of the oxygen containing gas cannot contact the coal, this gas will, after all, still flow through the remaining connecting channel, and will react there with the coal.

In the elongated gas chambers produced by this method the outflowing gas will, therefore, not contain oxygen until the moment that the narrow connecting channel has substantially completely disappeared, i.e. when the gas chamber has proceeded to the vicinity of the discharge borehole.

In the current prior methods two boreholes are drilled vertically into the coal layer. These boreholes, however, should be situated rather closely together so as to allow the formation of a connection either as a consequence of the natural permeability or through an artificial fissure. The maximum distance between the boreholes is, then, for instance 25 m. Thus a short gas chamber is obtained, in which the ratio between its length and the maximally obtainable perimeter of its transverse section is unfavourable. A consequence thereof is that, in such gas chambers, an insufficient length is present already in an early stage for the reduction reaction ($CO_2+C \rightarrow 2CO$) following the oxidation reaction ($C+O_2 \rightarrow CO_2$) to evolve completely, so that the gas quality will deteriorate before the chamber has completely been developed.

The narrow outflow channel which can be present for a long time in elongated gas chambers of the first kind accomplishes an extremely important task. It ensures that also oxygen which has not yet been in contact with the coal front upstream, e.g. because of roof collapses, nevertheless will take part in the gasification process. The outflow channel should, therefore, keep a certain length; if it becomes too short, the quality of the gas will decrease, and it will, eventually, begin to contain oxygen.

By means of the method according to the above-mentioned prior patent application 80 06 485, the cavity thus formed can be filled with a granular material with the exception of a remaining transport channel which remains in existence upslope along the coal wall against the roof, and which, during gasification of the next chamber, will accomplish the task of the said outflow channel.

The invention is based on the insight that it is not always advantageous or desired to continue the gasification as long as possible in order to make the gas chamber to extend as closely towards the discharge borehole, and to make, then, the discharge channel as short as possible before starting filling.

Moreover the invention is based on the insight that also gas chambers in which roof collapses have occurred can be completely filled, and also in these cases the finally remaining channel will be situated upwardly against the coal front, and will not, or only in a limited degree, extend along the roof collapses. This because also in the case of serious roof collapses a path will remain in existence above against the coal wall and below the roof formations overhanging the coal wall. Experiments on models have shown that the final channel will follow this path when filling the cavity, since said path is the path with the lowest flow velocity between the supply and discharge boreholes.

By interrupting the gasification in an earlier stage and subsequently filling the cavity, together or not with reversing the gasification sense at the beginning of the gasification in the next gas chamber, the gasification front can be controlled, and it can be forced to assume any desired shape and/or orientation.

This premature interruption of the gasification front in a gas chamber under development and subsequent filling of this chamber can, for example, be desired or necessary if, as a consequence of the gasification, collapses of the roof occur which might cause inadmissible subsidence at the ground level, which subsidence can be prevented by timely filling the gas chamber.

It can also be desirable to impart to the gasification front a given inclination, so that this front will cut into a fissure system or preferential direction of the permeability in the coal, already existent or to be formed, in such a manner that the gasification process will optimally develop.

The method of the invention is characterised in that in consecutive chambers the gasification is interrupted and the chamber is filled, together or not with the inversion of the gasification sense in the next chamber to be gasified, in order to adjust the gasification front upslope in a given desired direction and orientation, thereby avoiding inadmissible subsidence at the ground level.

The invention will be elucidated below by reference to three examples which are schematically illustrated in FIGS. 1-3.

BRIEF DESCRIPTION OF THE DRAWINGS

In FIG. 1 a section of a coal layer parallel to its slope is shown. Two boreholes 1 and 2 extend, as described in the prior NL patent application 77 10 184, in the direction of a coal layer 3. Downslope a connection has been formed between both boreholes by means of a third borehole 4 drilled along a curve from the ground level towards the coal layer 3 and intersecting or crossing both boreholes 1 and 2. During burning way a first gas chamber 5 with forward gasification from the borehole 1, it appears that subsidence can occur at the ground level which will become inadmissible at the moment that the foremost boundary of the gas chamber 5 has proceeded up to a point 6. Therefore the gasification is interrupted, and the chamber 5 is then filled with a granular material in the manner described in the prior NL patent application 80 06 485.

Now it is the intention that the gasification front is driven upwards along the slope transversely to both boreholes 1 and 2. To that end the gasification sense is inversed after pressing away the liquid if liquid was used as a carrier, and thereafter the shorter gas chamber 5' is burned away by forward gasification from the borehole 2. After filling the latter chamber and pressing away the liquid again, the gasification sense is reversed again, and the gas chamber 7 is burned away from the borehole 1. The latter chamber is to be filled again if subsidence at the ground level should become inadmissible. Thereafter the chamber 7' is burned away in the opposite sense.

In this manner also the chambers 8–9' are consecutively gasified, and arrows in these chambers indicate the gasification sense. It will be clear that in this manner the gasification front will be displaced substantially parallel to itself upslope and transversely to the boreholes 1 and 2. The shape and extension of the filled cavity and of the lastly operative gas chamber can be determined at any desired moment by means of geophysical measurements.

Figure 1:
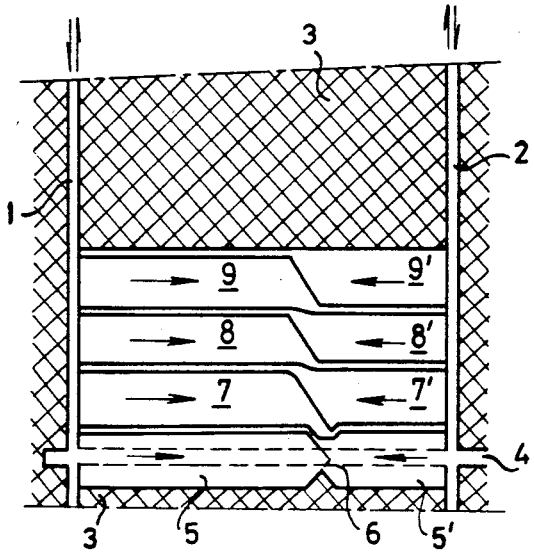
FIG. 1 is an elevational cross section into a coal layer showing the upward progression of the gasification front along a plane substantially parallel to the ground surface.
Figure 2:
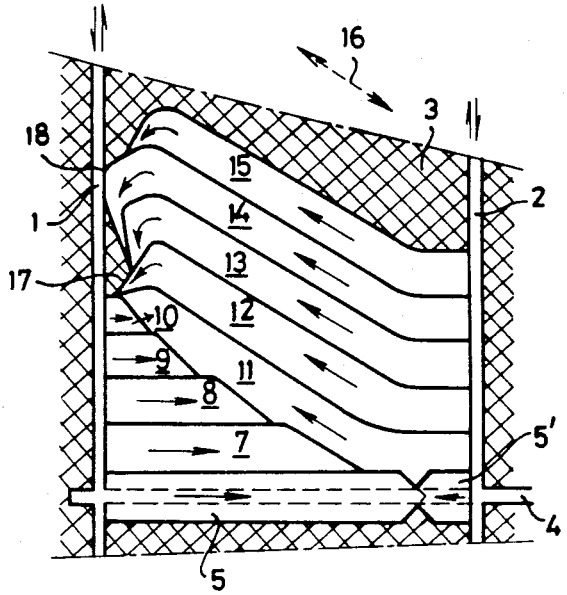
FIG. 2 is an elevational cross section of a coal deposit showing control of the gasification front along a plane substantially parallel to the dotted line arrow 16.

FIG. 2 shows a section of a coal layer parallel to its inclination. Again two boreholes 1 and 2 are present extending in the direction of the coal layer 3. Again a connection between both boreholes has been affected downslope by means of a third borehole 4 drilled from the surface in a curve towards the coal layer 3 and intersecting or crossing both boreholes 1 and 2.

Now it is desired to displace the gasification front upslope and parallel to the direction of the interrupted arrow 16. This can, for instance, be realised by gasifying the first gas chamber 5 from the borehole 1 up to the vicinity of the discharge borehole 2, subsequently filling this chamber, and thereafter pressing away the liquid. Then the remaining gas chamber 5' is burned way in the opposite sense from the borehole 2. Subsequently the gasification sense is reversed again, and the gas chambers 7–10 are burned away and filled in the manner shown. Thereafter the gasification sense is reversed again, and the chambers 11–15 are burned away and filled in the manner shown. The channels remaining after filling of the consecutive chambers 11–15, forming a connection with the borehole 1, will be directed towards an opening in this borehole as indicated at 17, and, therefore, will gradually become longer. Finally a break-through towards a higher hole 18 present or being formed in the borehole 1 can occur, which can also be brought about by the combustion itself.

Figure 3:
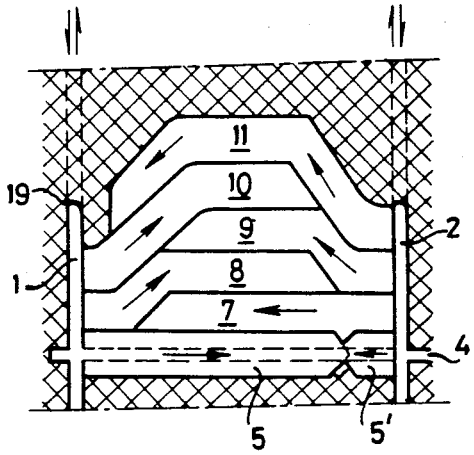
FIG. 3 shows an elevational cross section of a coal deposit wherein a dome shaped gasification front is maintained by controlled intermittent reversal of the gas flow between the two bore holes.

FIG. 3 shows a section through a coal layer parallel to its inclination. Again two boreholes 1 and 2 extending in the direction of the coal layer 3 have been drilled. Again a connection 4 downslope between the boreholes 1 and 2 has been brought about by means of a third borehole 4 drilled from the surface in a curve towards the coal layer 3 and intersecting or crossing both boreholes 1 and 2. Both boreholes 1 and 2 enter the coal layer at 19. Now it is desired to continue the gasification upslope and past the connecting line between the points 19. This can be obtained by burning away and fill the gas chambers, in the example shown the chambers 5–11, alternately from either side, taking care that said chambers partly overlap.

I claim:

1. A method for the underground gasification of coal or browncoal in an inclined coal layer, in which two boreholes are drilled from the ground level into the coal layer, which boreholes are continued downwards in said layer with the slope of said layer, and are interconnected at their lower ends, after which the coal is ignited, and, furthermore, by supplying an oxygen containing gas through one of the boreholes and discharging the combustion gas through the other borehole, the combustion and gasification front is propagated upslope, care being taken that the boreholes remain in communication with the cavity behind the combustion front, the cavity being intermittently filled with a filler supplied through one of the boreholes, said filling material being suspended in a carrier substance, said suspension being led through the boreholes and the cavity in such a concentration and flow rate that the filling material, because of the speed reduction when entering the cavity, will precipitate, leading through of this suspension being continued until the cavity is completely filled with the filling material with the exception of a channel at the upper side of this space near the coal front, after which, if required, the carrier substance in the filled chamber is pressed away towards a desired level, further comprising the step of intermittently filling the cavity before said cavity has reached said discharge borehole.

2. The method of claim 1, further comprising the step of reversing the gas flow through said supply and discharge boreholes to thereby reverse movement of the gasification front in said cavity.

3. The method of claim 1 or 2 wherein said intermittent filling is timed so as to avoid undesirable subsidence of the ground surface.

4. The method of claim 1 or 2 wherein said intermittent filling is timed so as to cause the gasification front to assume a desired orientation and shape .

5. The method of claim 2 wherein said intermittent filling and/or said gas flow reversal are timed so as to cause the gasification front to assume a desired orientation and shape.

* * * * *